US007107141B2

(12) United States Patent
Stroh

(10) Patent No.: US 7,107,141 B2
(45) Date of Patent: Sep. 12, 2006

(54) METHOD FOR OBTAINING AXLE-TORQUE DRIVABILITY WITH ENGINE TORQUE-BASED SYSTEM

(75) Inventor: David J. Stroh, Farmington Hills, MI (US)

(73) Assignee: General Motors Corporation, Detroit, MI (US)

( * ) Notice: Subject to any disclaimer, the term of this patent is extended or adjusted under 35 U.S.C. 154(b) by 46 days.

(21) Appl. No.: 10/781,276

(22) Filed: Feb. 18, 2004

(65) Prior Publication Data

US 2005/0182556 A1 Aug. 18, 2005

(51) Int. Cl.
*F02D 11/10* (2006.01)

(52) U.S. Cl. ..... 701/110; 123/350

(58) Field of Classification Search ..... 701/110, 701/54; 123/406.23, 332–335, 481, 339.19, 123/350; 477/108, 110, 186, 187
See application file for complete search history.

(56) References Cited

U.S. PATENT DOCUMENTS

| | | | | |
|---|---|---|---|---|
| 4,301,883 | A * | 11/1981 | Collonia | 180/179 |
| 4,724,723 | A * | 2/1988 | Lockhart et al. | 477/102 |
| 6,052,644 | A * | 4/2000 | Murakami et al. | 701/93 |
| 6,318,349 | B1 * | 11/2001 | Muto et al. | 123/674 |
| 6,769,403 | B1 * | 8/2004 | Rayl et al. | 123/406.23 |
| 6,895,941 | B1 * | 5/2005 | Matthews et al. | 123/481 |

* cited by examiner

*Primary Examiner*—Andrew M. Dolinar
*Assistant Examiner*—Johnny H. Hoang
(74) *Attorney, Agent, or Firm*—Christopher DeVries

(57) ABSTRACT

A control system that controls operation of an engine to achieve a desired vehicle drive characteristic includes a pedal sensor that generates a pedal device position signal and an adjusted pedal module that determines an adjusted pedal based on the pedal device position signal and a vehicle speed. An engine torque request module determines an engine torque request based on said adjusted pedal and an engine speed.

33 Claims, 5 Drawing Sheets

METHOD FOR OBTAINING AXLE-TORQUE DRIVABILITY WITH ENGINE TORQUE-BASED SYSTEM

FIELD OF THE INVENTION

The present invention relates to vehicle drive character, and more particularly to controlling vehicle drive character based on engine torque.

BACKGROUND OF THE INVENTION

Traditionally, automobiles are driven by an internal combustion engine (ICE) that produces drive torque. The drive torque is transferred through a powertrain to drive wheels. The powertrain includes a transmission that transfers drive torque through a gear reduction. The desired drive torque is regulated by a driver input, such as an accelerator pedal or a cruise control system. A particular drive characteristic (i.e., acceleration or feel) is associated with the desired drive torque.

Torque-based control can be implemented to achieve the desired drive characteristic. Using an axle torque-based control, the accelerator pedal position is interpreted as a desired axle torque. The engine and transmission are controlled to deliver the desired axle torque to provide the desired drive characteristic. In some applications (e.g., manual transmissions) it is not possible to use an axle torque-based control. An engine torque-based control is used instead. Using the engine torque-based control, the accelerator pedal position is interpreted as an engine torque request and the engine is controlled to deliver the requested engine torque to provide the desired drive characteristic.

Difficulties have arisen in achieving the same drive characteristic whether using the axle torque-based control or the engine torque-based control. In other words, the same drive characteristic or feel achieved using the axle torque-based control is not achieved using the engine torque-based control.

SUMMARY OF THE INVENTION

Accordingly, the present invention provides a control system that controls operation of an engine to achieve a desired vehicle drive characteristic. The control system includes a pedal sensor that generates a pedal device position signal and an adjusted pedal module that determines an adjusted pedal based on the pedal device position signal and a vehicle speed. An engine torque request module determines an engine torque request based on said adjusted pedal and an engine speed.

In one feature, the control system further includes a controller that controls said engine based on said engine torque request to produce a desired engine torque.

In one feature, the control system further includes an output shaft speed sensor that generates an output shaft speed signal. The output shaft speed signal is indicative of a rotational speed of an output shaft of a transmission that is driven by the engine. The vehicle speed is based on the output shaft speed signal.

In another feature, the adjusted pedal is determined from a look-up table based on the throttle device position and the vehicle speed.

In another feature, the adjusted pedal module calculates the adjusted pedal adjusted pedal based on the pedal device position and the vehicle speed using a mathematical model.

In another feature, the engine torque request is determined from a look-up table based on the adjusted pedal and the engine speed.

In still another feature, the engine torque request module calculates the engine torque request based on the adjusted pedal and the engine speed using a mathematical model.

In yet another feature, the control system further includes an engine speed sensor that generates an engine speed signal.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
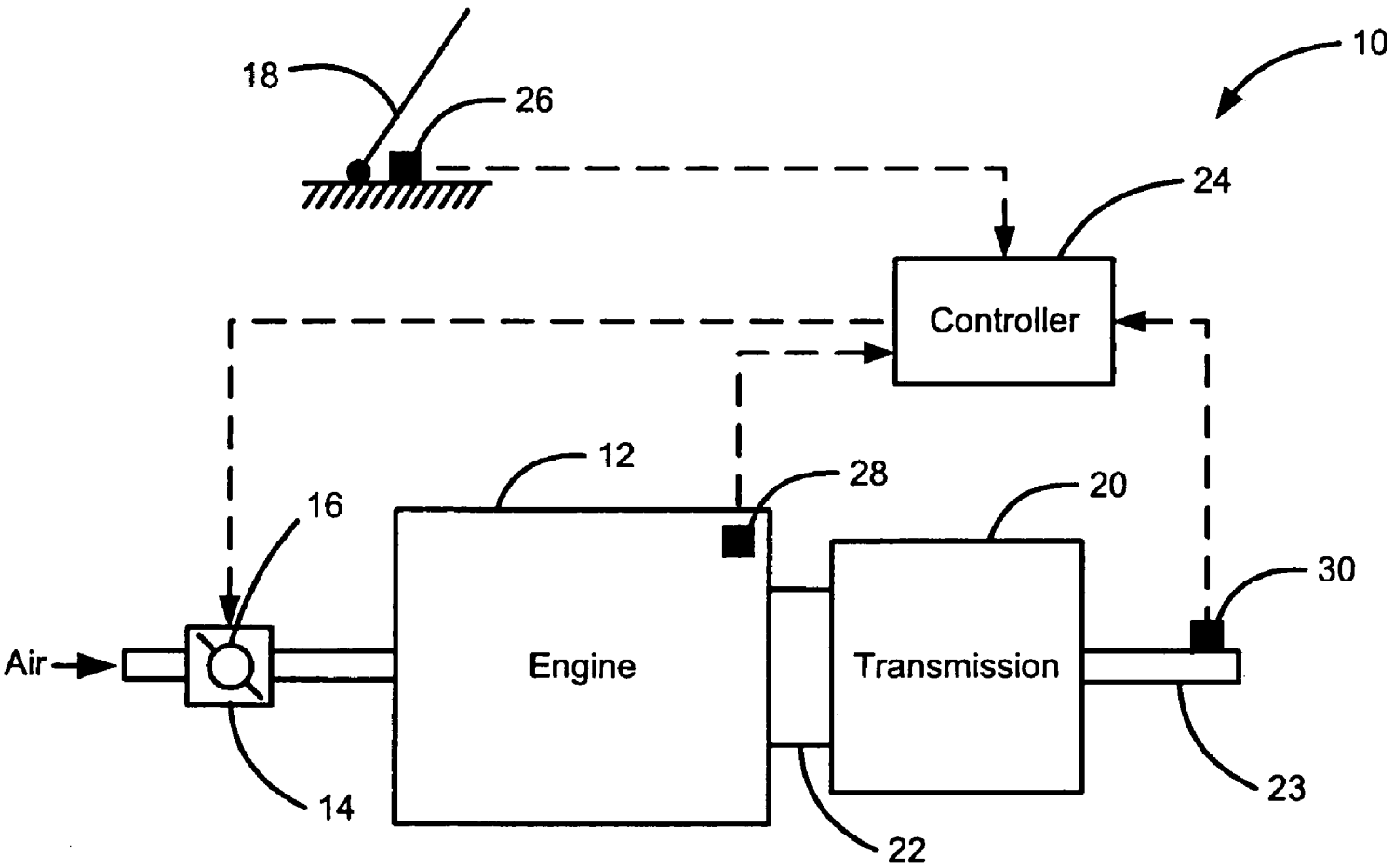
FIG. 1 is a schematic illustration of an vehicle driveline according to the present invention.

The following description of the preferred embodiments is merely exemplary in nature and is in no way intended to limit the invention, its application, or uses. For purposes of clarity, the same reference numbers will be used in the drawings to identify similar elements.

Referring now to FIG. 1, a vehicle driveline 10 includes an internal combustion engine 12 and an electronically controlled throttle 14 that regulates mass air flow into the engine 12. More particularly, a throttle blade 16 is articulated with an electric motor based on a pedal input 18 to regulate mass air flow through the throttle 14. The pedal input 18 can include an acceleration pedal, a cruise control system (not shown) or any other input device that indicates a desired pedal position. Air flow into the engine 12 is mixed with fuel and the mixture is combusted to drive pistons (not shown) to produce drive torque.

Drive torque produced by the engine 12 is transferred to a transmission 20 through a coupling 22. In the case of an automatic transmission, the coupling 22 is a torque converter. In the case of a manual transmission, the coupling 22 is a clutch. In the case of an automated manual transmission, the coupling 22 is an electronically controlled clutch. The coupling 22 regulates drive torque transfer from the engine 12 to the transmission 20. The transmission 20 includes an output shaft 23 that drives wheels (not shown).

A control system regulates operation of the engine 12 based on the engine torque-based control of the present invention. More specifically, a controller 24 monitors and regulates vehicle operation based on several inputs according to the engine torque-based control. A pedal input position sensor 26 generates a pedal input position signal, which is received by the controller 24. An engine speed sensor 28 generates an engine speed signal (RPM) and an output shaft speed sensor 30 generates an output shaft speed signal, both of which are received by the controller 24. The controller 24 processes the various signals according to the engine torque-based control and generates at least one command signal. Engine operation is controlled based on the command signal(s).

The engine torque-based control of the present invention determines an engine torque request based on engine speed, pedal input position and vehicle speed. The engine speed signal is used to determine the engine speed and the pedal position signal is used to determine the pedal position. The vehicle speed is determined based on the output shaft speed signal.

The engine torque-based control determines an adjusted pedal based on the pedal input position and the vehicle speed. The adjusted pedal is a manipulation between the position indicated by the actual pedal input position and the pedal input position needed to achieve the desired drive characteristic. The adjusted pedal is a calibrated value based on the acceleration characteristics of the particular vehicle and results in a comfortable drive feel as the vehicle accelerates. The adjusted pedal is calibrated based on vehicle speed. For example, for a lower vehicle speed a higher gain may be provided, which results in quicker acceleration. For a higher vehicle speed a lower gain may be provided, which results in slower acceleration.

The engine torque request is determined based on the engine speed and the adjusted pedal. In this manner, the engine torque request accounts for the desired drive characteristic. The controller 24 operates the engine to achieve the engine torque request, thereby achieving the desired drive characteristic.

Figure 2:
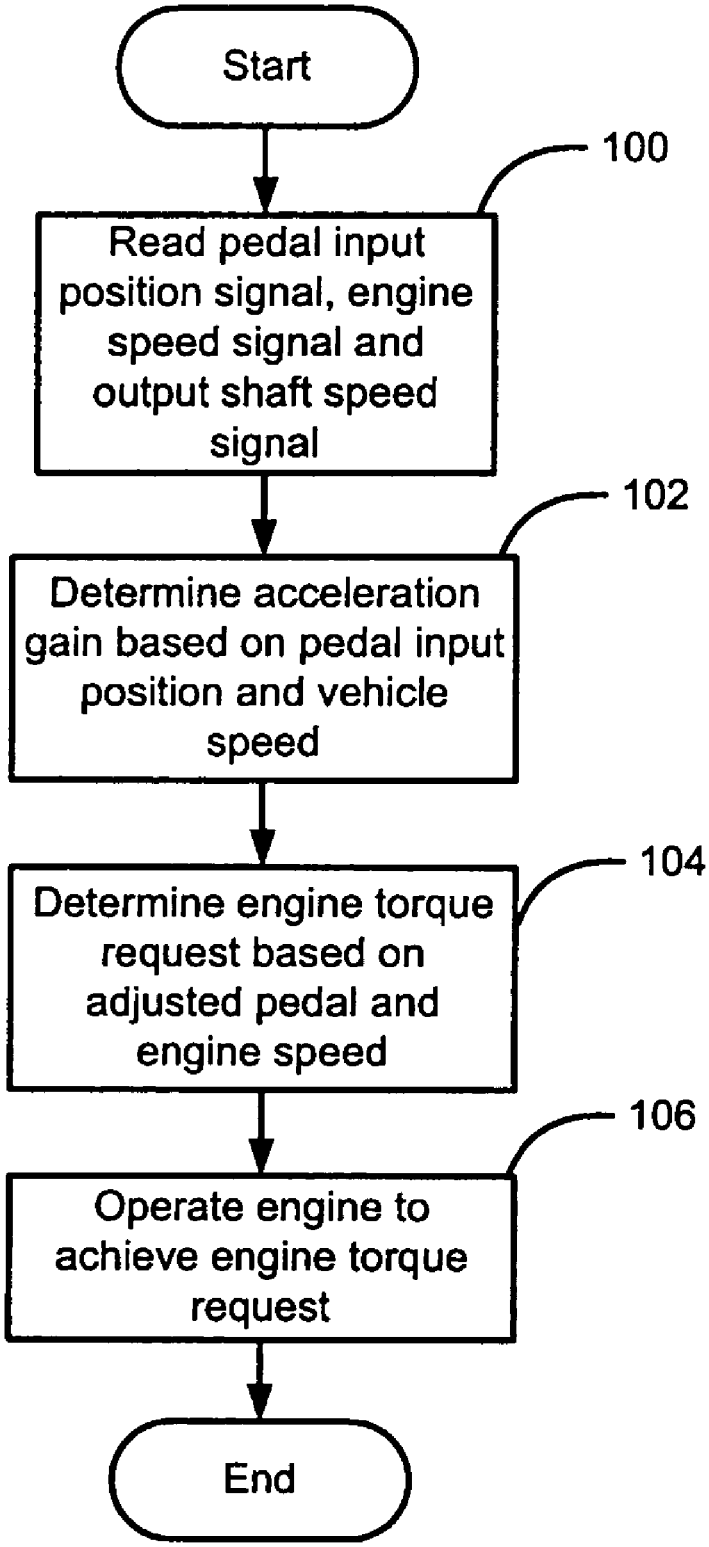
FIG. 2 is a flowchart illustrating engine torque-based control according to the present invention.

Referring now to FIG. 2, the engine torque-based control of the present invention will be described in detail. In step 100, control reads the pedal input position signal, the engine speed signal and the output shaft speed signal. Control determines the adjusted pedal based on the pedal position and the vehicle speed in step 102. The adjusted pedal is preferably determined from a three-dimensional (3D) surface (see FIG. 3) based on the pedal position and the vehicle speed. The 3D surface is constructed from a look-up table. However, it is anticipated that the adjusted pedal can be calculated based on the throttle input position signal and the vehicle speed using a mathematical model.

In step 104, control determines the engine torque request based on the pedal position adjusted pedal and the engine speed. The engine torque request is preferably determined from a three-dimensional (3D) surface (see FIG. 4) based on the pedal position and the vehicle speed. The 3D surface is constructed from a look-up table. However, it is anticipated that the engine torque request can be calculated based on the adjusted pedal and the engine speed using a mathematical model. In step 106, control operates the engine to achieve the engine torque request.

Figure 3:
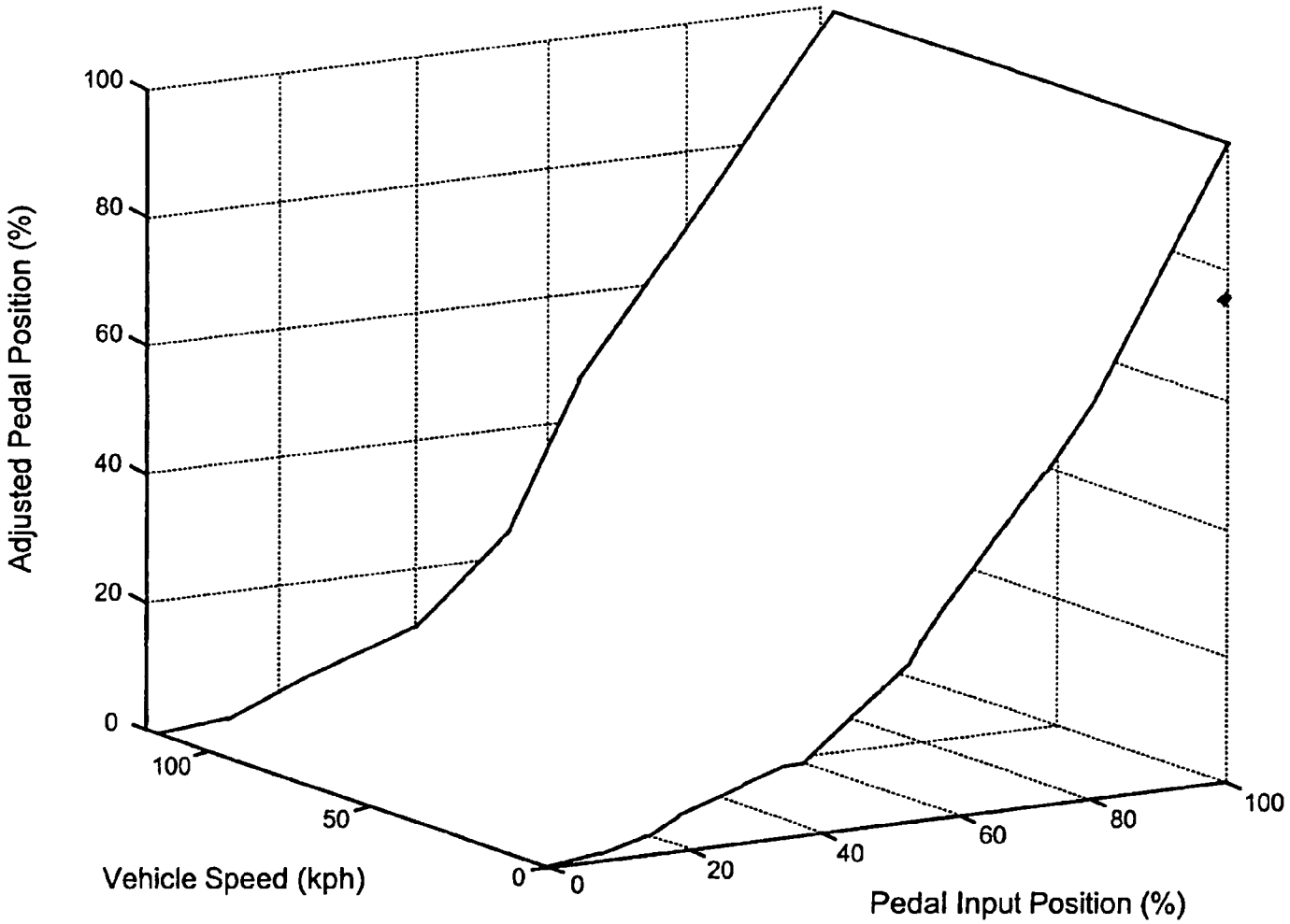
FIG. 3 is an exemplary three-dimensional (3D) surface implemented to determine an adjusted pedal.
Figure 4:
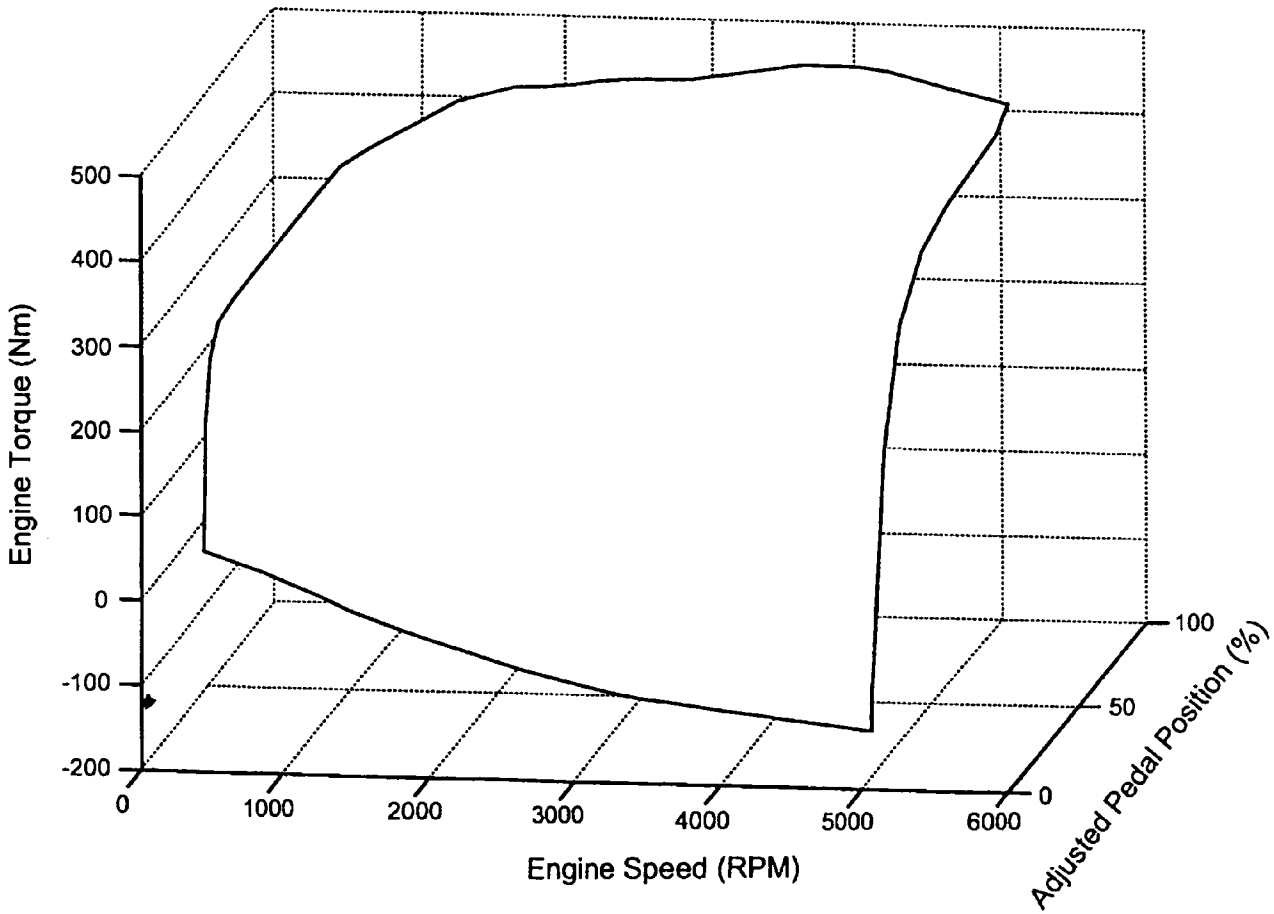
FIG. 4 is an exemplary 3D surface implemented to determine an engine torque request.

Referring now to FIGS. 3 and 4, respective 3D surfaces are illustrated for determining the adjusted pedal and the engine torque request. More specifically, the 3D surfaces are graphical illustrations of the look-up tables implemented for determining the adjusted pedal and the engine torque request.

Figure 5:
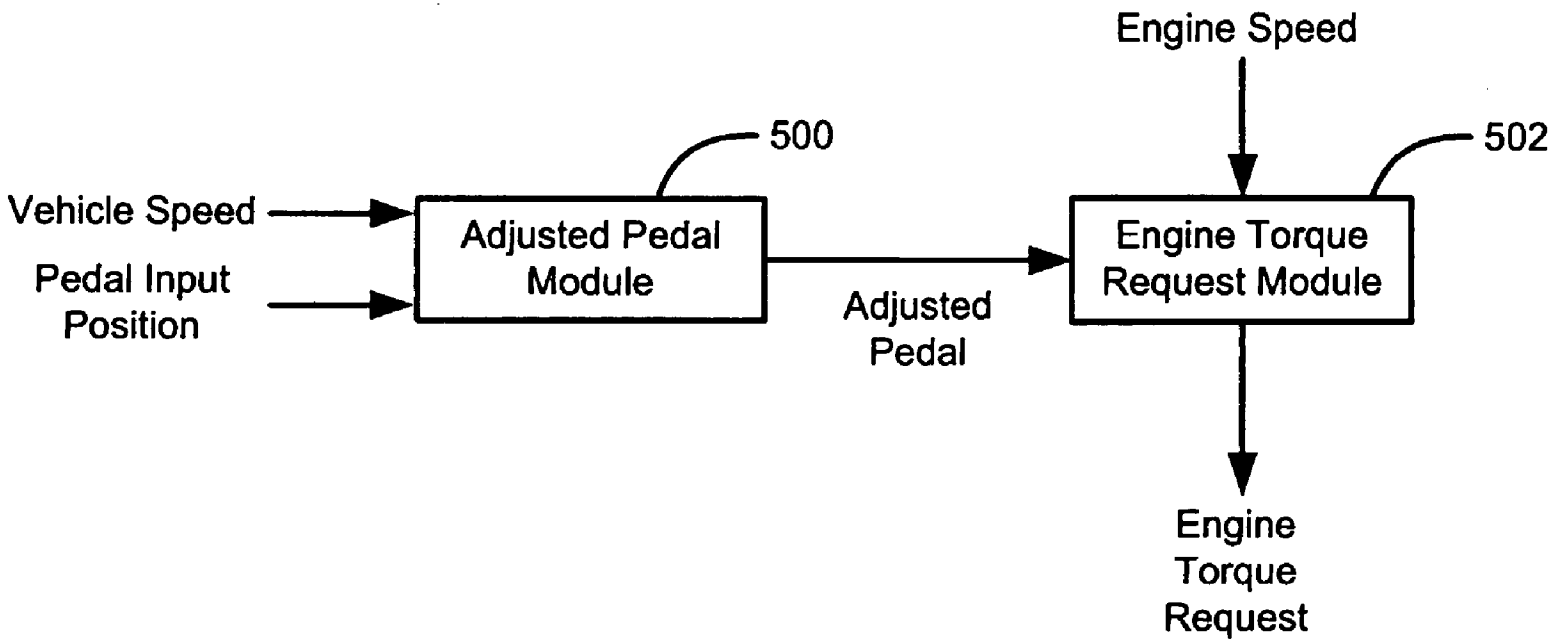
FIG. 5 is a logic diagram illustrating the engine torque-based control.

Referring now to FIG. 5, a logic diagram illustrates the engine torque-based control of the present invention. An adjusted pedal module 500 determines the adjusted pedal based on vehicle speed and pedal input position signals. The adjusted pedal is output to an engine torque request module 502. The engine torque request module 502 determines the engine torque request based on the adjusted pedal and an engine speed signal. The engine torque request is output to a controller, such as the controller 24, which operates the engine 12 to achieve the engine torque request.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A control system that controls operation of an engine to achieve a desired vehicle drive characteristic, comprising:

a pedal sensor that generates a pedal device position signal;

an adjusted pedal module that determines an adjusted pedal based on said pedal device position signal and a vehicle speed, wherein said adjusted pedal is a calibrated value based on a desired drive characteristic, which provides a comfortable drive feel as the vehicle accelerates; and an engine torque request module that determines an engine torque request based on said adjusted pedal and an engine speed.

2. The control system of claim 1 further comprising a controller that controls said engine based on said engine torque request to produce a desired engine torque.

3. The control system of claim 1 further comprising an output shaft speed sensor that generates an output shaft speed signal, wherein said output shaft speed signal is indicative of a rotational speed of an output shaft of a transmission that is driven by said engine.

4. The control system of claim 3 wherein said vehicle speed is based on said output shaft speed signal.

5. The control system of claim 1 wherein said adjusted pedal is determined from a look-up table based on said pedal input position and said vehicle speed.

6. The control system of claim 1 wherein said adjusted pedal module calculates said adjusted pedal based on said pedal device position and said vehicle speed using a mathematical model.

7. The control system of claim 1 wherein said engine torque request is determined from a look-up table based on said adjusted pedal and said engine speed.

8. The control system of claim 1 wherein said engine torque request module calculates said engine torque request based on said adjusted pedal and said engine speed using a mathematical model.

9. The control system of claim 1 further comprising an engine speed sensor that generates an engine speed signal.

10. A control system that controls operation of an engine to achieve a desired vehicle drive characteristic, comprising:

a pedal device;

a pedal sensor that generates a pedal device position signal; and a controller that determines an adjusted pedal based on said pedal device position signal and a vehicle speed, that determines an engine torque request based on said adjusted pedal and an engine speed and that controls said engine based on said engine torque request to produce a desired engine torque, wherein said adjusted pedal is a calibrated value based on a desired a drive characteristic, which provides a comfortable drive feel as the vehicle accelerates.

11. The control system of claim 10 further comprising an output shaft speed sensor that generates an output shaft speed signal, wherein said output shaft speed signal is indicative of a rotational speed of an output shaft of a transmission that is driven by said engine.

12. The control system of claim 11 wherein said vehicle speed is based on said output shaft speed signal.

13. The control system of claim 10 wherein said adjusted pedal is determined from a look-up table based on said throttle input position and said vehicle speed.

14. The control system of claim 10 wherein said controller calculates said adjusted pedal based on said pedal device position and said vehicle speed using a mathematical model.

15. The control system of claim 10 wherein said engine torque request is determined from a look-up table based on said adjusted pedal and said engine speed.

16. The control system of claim 10 wherein said controller calculates said engine torque request based on said adjusted pedal and said engine speed using a mathematical model.

17. The control system of claim 10 further comprising an engine speed sensor that generates an engine speed signal.

18. A method of controlling operation of an engine to achieve a desired vehicle drive characteristic, comprising:

determining an adjusted pedal based on a pedal position and a vehicle speed, wherein said adjusted pedal is a calibrated value based on a desired drive characteristic, which provides a comfortable drive feel as the vehicle accelerates;

determining an engine torque request based on said adjusted pedal and an engine speed; and controlling said engine based on said engine torque request to produce a desired engine torque.

19. The method of claim 18 further comprising:

generating a pedal input position signal using a pedal position sensor; and generating an output shaft speed signal using an output shaft speed sensor, wherein said output shaft speed signal is indicative of a rotational speed of an output shaft of a transmission that is driven by said engine.

20. The method of claim 19 further comprising determining said vehicle speed based on said output shaft speed signal.

21. The method of claim 18 wherein said adjusted pedal is determined from a look-up table based on said pedal input position and said vehicle speed.

22. The method of claim 18 wherein said adjusted pedal is calculated based on said pedal input position and said vehicle speed using a mathematical model.

23. The method of claim 18 wherein said engine torque request is determined from a look-up table based on said adjusted pedal and said engine speed.

24. The method of claim 18 wherein said engine torque request is calculated based on said adjusted pedal and said engine speed using a mathematical model.

25. The method of claim 18 further comprising generating an engine speed signal using an engine speed sensor.

26. A vehicle having an engine that is controlled using an engine torque-based control to achieve a desired vehicle drive characteristic, comprising:

a pedal device; and a controller that determines an adjusted pedal based on a position of said pedal device and a vehicle speed, that determines an engine torque request based on said adjusted pedal and an engine speed and that controls said engine based on said engine torque request to produce a desired engine torque, wherein said adjusted pedal is a calibrated value based on a desired drive characteristic which provides a comfortable drive feel as the vehicle accelerates.

27. The vehicle of claim 26 further comprising a pedal sensor that generates a throttle device position signal.

28. The vehicle of claim 26 further comprising:

a transmission that is driven by said engine and that includes an output shaft; and an output shaft speed sensor that generates an output shaft speed signal, wherein said vehicle speed is determined based on said output shaft speed signal.

29. The vehicle of claim 26 wherein said adjusted pedal is determined from a look-up table based on said pedal device position and said vehicle speed.

30. The vehicle of claim 26 wherein said controller calculates said adjusted pedal based on said pedal device position and said vehicle speed using a mathematical model.

31. The vehicle of claim 26 wherein said engine torque request is determined from a look-up table based on said adjusted pedal and said engine speed.

32. The vehicle of claim 26 wherein said controller calculates said engine torque request based on said adjusted pedal and said engine speed using a mathematical model.

33. The vehicle of claim 26 further comprising an engine speed sensor that generates an engine speed signal.

* * * * *